US012702152B1

(12) United States Patent
Almonte

(10) Patent No.: US 12,702,152 B1
(45) Date of Patent: Aug. 11, 2026

(54) SMOKING ARTICLE AND METHOD FOR A CIGAR OR CIGARILLO USING OPTIONAL SECOND FILTER AND SLIDABLE SLEEVE

(71) Applicant: IP TRADEMARK HOLDINGS INC, Mandeville, LA (US)

(72) Inventor: Pedro Almonte, Santiago (DO)

(73) Assignee: IP Trademark Holdings, Inc., Mandeville, LA (US)

( * ) Notice: Subject to any disclaimer, the term of this patent is extended or adjusted under 35 U.S.C. 154(b) by 481 days.

(21) Appl. No.: 18/341,426

(22) Filed: Jun. 26, 2023

(51) Int. Cl.

| | |
|---|---|
| ***A24C 3/00*** | (2006.01) |
| ***A24C 5/00*** | (2020.01) |
| ***A24C 5/47*** | (2006.01) |
| ***A24D 1/00*** | (2020.01) |
| ***A24D 1/02*** | (2006.01) |
| ***A24D 1/04*** | (2006.01) |
| ***A24D 3/02*** | (2006.01) |
| ***A24D 3/04*** | (2006.01) |
| *B65D 85/12* | (2006.01) |

(52) U.S. Cl.
CPC ..... *A24C 3/00* (2013.01); *A24C 5/47* (2013.01); *A24D 1/022* (2013.01); *A24D 1/045* (2013.01); *A24D 3/0275* (2013.01); *A24D 3/04* (2013.01); *B65D 85/12* (2013.01); *B65D 2203/12* (2013.01)

(58) Field of Classification Search
None
See application file for complete search history.

(56) References Cited

U.S. PATENT DOCUMENTS

2017/0042218 A1* 2/2017 Sinclair, Jr. ..... A24C 5/40

* cited by examiner

*Primary Examiner* — Dennis R Cordray
(74) *Attorney, Agent, or Firm* — Roy Kiesel Ford Doody & North, APLC; Brett A. North

(57) ABSTRACT

A method of constructing a cigar, including the steps of: (a) providing a cigar shell having an interior, and a form mandrel having an interior mandrel volume and being substantially located inside the interior shell volume, wherein the cigar shell, form mandrel are packaged for sale inside packaging; opening the packaging and removing the cigar shell, and forming a cigar using the shell and form mandrel.

13 Claims, 9 Drawing Sheets

FIG. 1
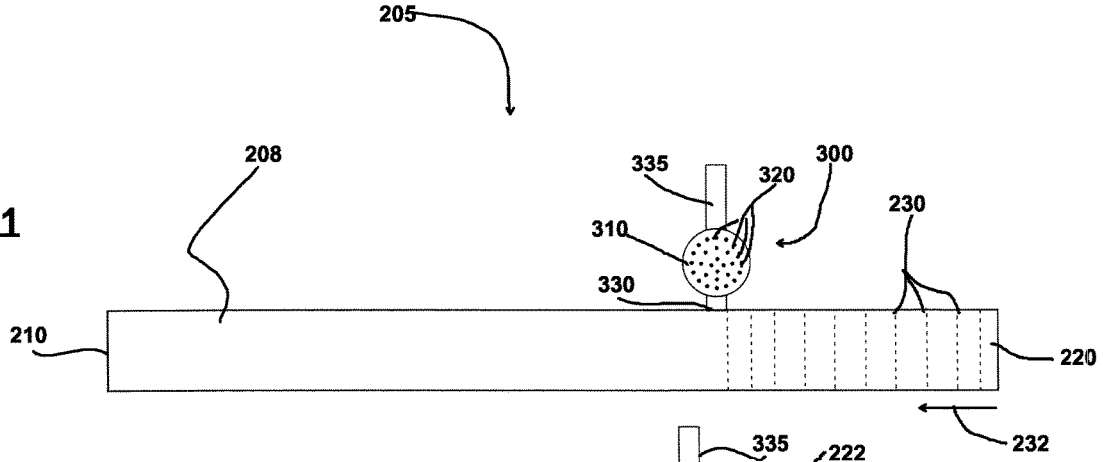
FIG. 2
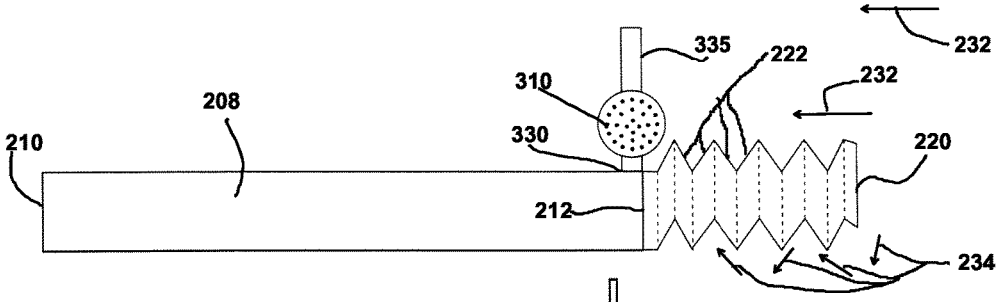
FIG. 3
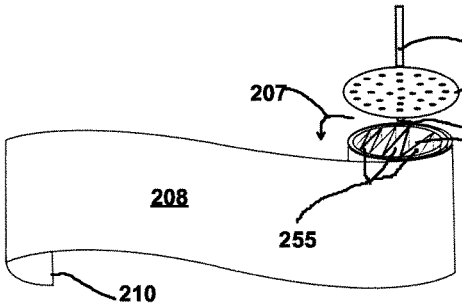
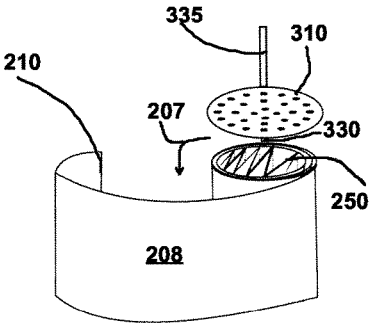
FIG. 4
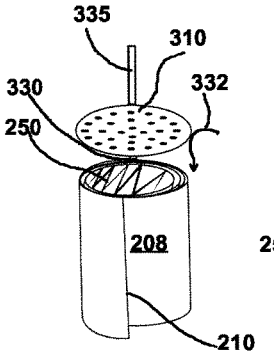
FIG. 5
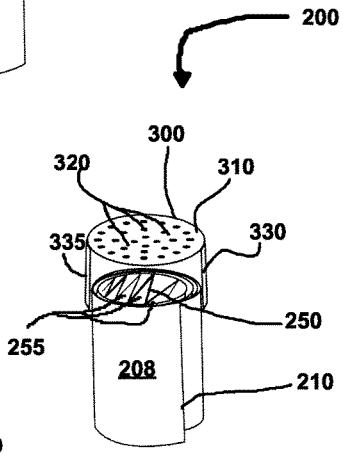
FIG. 6

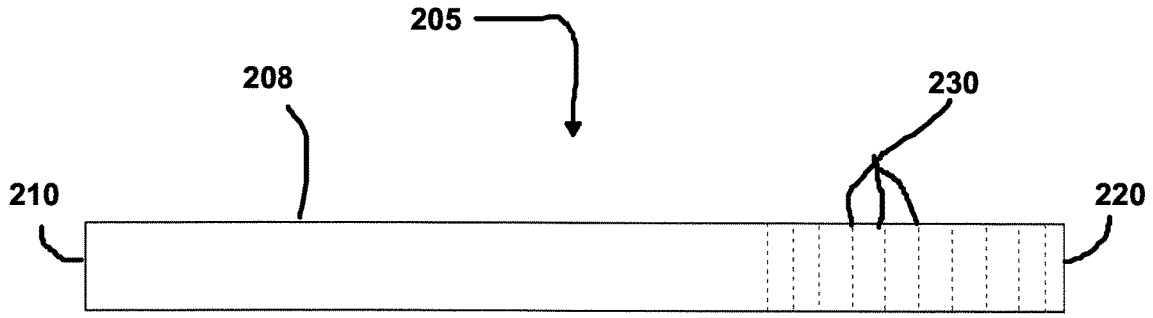
FIG. 28
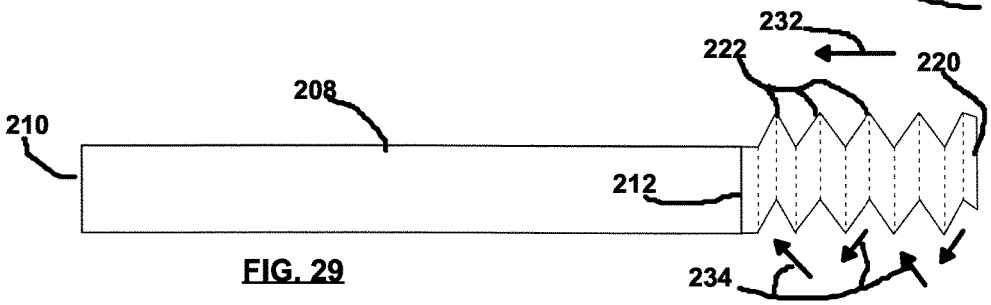
FIG. 29
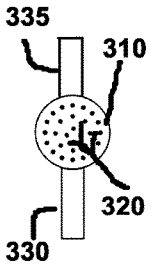
FIG. 31
FIG. 30
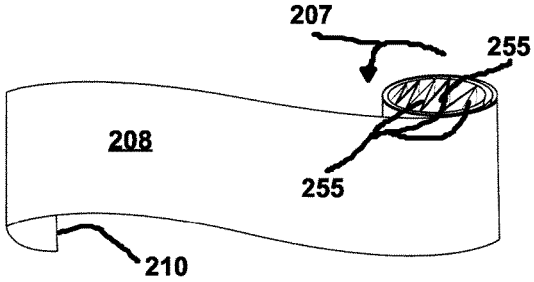
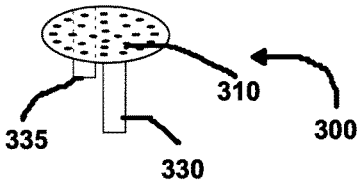
FIG. 32
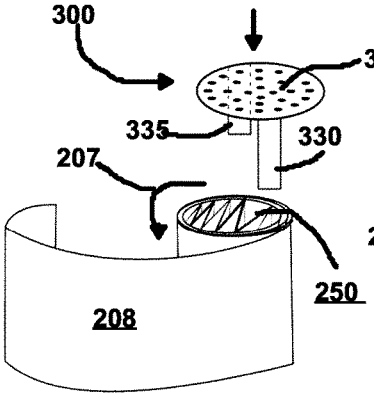
FIG. 33
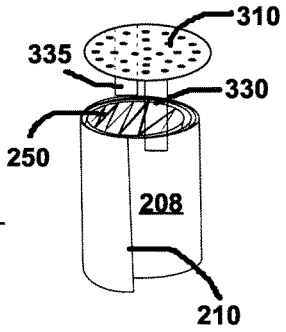
FIG. 34
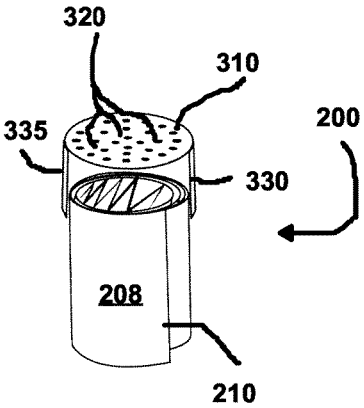
FIG. 35

SMOKING ARTICLE AND METHOD FOR A CIGAR OR CIGARILLO USING OPTIONAL SECOND FILTER AND SLIDABLE SLEEVE

BACKGROUND OF THE INVENTION

In recent years, smoking of cigars has become fashionable and numerous cigar shops have opened around the world to satisfy this growing trend. The variety, quality and size of ready-made cigars satisfy the majority of the public. However, a small segment of connoisseurs insist that nothing can compare with the taste and smell of custom-blended smoking products. These knowledgeable individuals are very selective in the manner in which their cigars are rolled and in the smokable filler used in the cigars.

SUMMARY OF THE INVENTION

The present invention relates to smoking tobacco products, namely a cigar that enables a smoker or consumer to fabricate one or more custom cigars.

In one embodiment is provided a kit for making a cigar which includes a cylindrically shaped cigar shell having a shell interior and shell longitudinal centerline, a form mandrel for maintaining the cylindrical shape of the cigar shell, the form mandrel having a form interior, a blocking tip which allows air flow to pass but blocks smokable filler which placed in the shell interior, and a rod or straw which can be used to pack or compact smokable filler is placed in the shell interior and blocked by the blocking tip.

In one embodiment the kit is packaged for sale with the cigar shell being substantially or completely unfilled with smokable filler, the form mandrel being located substantially inside the shell interior, and the rod or straw being located substantially inside both the form mandrel interior and the shell interior.

In one embodiment the blocking tip includes first and second blocking portions with respective first and second blocking porosities, wherein the first blocking portion is optionally separable from the second blocking portion and the first and second blocking porosities are not different from each other.

In one embodiment the first blocking porosity has a mean pore size which is smaller than the mean pore size of the second blocking porosity. In various embodiments the first blocking porosity has a mean pore size which is less than ½ the mean pore size of the second blocking porosity. In various embodiments the mean pore size of the first blocking porosity is less than ½, ⅓, ¼, ⅕, ⅙, 1/10, 1/11, 1/12, 1/15, 1/20, 1/25, 1/30, 1/35, 1/40, 1/50, 1/60, 1/75, 1/80, 1/90, 1/100, 1/125, 1/150/1/175, and/or 1/200 the means pore size of the second blocking porosity. In various embodiments the mean pore size of the first blocking porosity can fall within a range of between any two of the above referenced relative sizes of the second blocking porosity.

In one embodiment the kit may be packaged in flexible packaging such as a foil pouch which cigar shell's shape is generally preserved in the packaging using the form mandrel being located substantially inside the shell interior.

In one embodiment, while the form mandrel is located substantially in the interior of the cigar shell such that a substantial portion of the interior of the form mandrel is located inside the interior of the cigar shell, a user places smokable filler in the interior of the form mandrel during to fill said form mandrel interior, and simultaneously fill the cigar shell interior by virtue of the form mandrel being located substantially in the interior of the form mandrel.

filling, wherein during the filling process the smokable filler both passes through the interior of the support insert, and the support insert is longitudinally relative to the cigar shell in a direction opposite of the direction that the smokable filler passes through the supporting insert.

In one embodiment, the user uses the straw or rod to "pack" or "compact" the smokable filler previously placed in the interior of the form mandrel (which is also located in the interior of the cigar shell due to the form mandrel being substantially located in the interior of the cigar shell). In one embodiment the form mandrel substantially prevents any concentrated and/or localized forces (resulting from said packing or compacting of the smokable filler) from being transferred to the cigar shell itself which forces would have a tendency to cause a localized tear or rupture of the wall of the cigar shell.

In one embodiment, after filling and packing/compacting smokable filler in a substantial longitudinal portion of the interior of the form mandrel (and consequently a substantial longitudinal portion of the interior of the cigar shell as the form mandrel is substantially located in the interior of the cigar shell), the form mandrel is removed from the interior of the cigar shell while the filled and packed/compacted smokable filler remains longitudinally static relative the interior of the cigar shell. In one embodiment the filler can be made to remain longitudinally static relative to the cigar shell by placing a longitudinal force on the filler while pulling on the form mandrel and while holding still the cigar shell. In this manner the smokable filler can remain in the interior of the cigar shell while the form mandrel is pulled out of the cigar shell and away from the smokable filler.

In one embodiment the form mandrel forms a protective barrier in regards to the wall of the cigar shell protecting said wall from damage or failure during the packing/compacting step of the smokable filler located inside both the interior of form mandrel and the interior of the cigar shell.

In one embodiment the method can include removing a first cigar (filled with tobacco filler) from a package, removing a form mandrel from such first cigar creating an interior longitudinal bore, and smoking such first cigar wherein the longitudinal bore controls the draw during smoking.

In one embodiment, instructions are provided on the packaging teaching the squeezing of the cigar or cigarillo in a direction substantially perpendicular to the longitudinal axis to decrease air flow though the longitudinal draw during smoking.

In one embodiment a form mandrel can be located in the interior of the cigar shell cigar such that the cross section of these two items creates a set of concentric circles, the innermost circle being the form mandrel, and the outermost circle being the cigar shell. In different embodiments, the ratio of the radius of the form mandrel section to the radius of the cigar shell section is 1 to: 1.2, 1.1, 1.09, 1.08, 1.07, 1.05, 1.04, 1.03, 1.02, 1.01, 1.005, and/or 1.001. Various embodiments can include possible ranges between any of the combinations of the above listed ratios. For example, between 1:1.005 and 1:1.1; 1:1.001 and 1:1.02, etc.

In various embodiment s the cigar shell can include various configurations of pre-rolled sheets. One embodiment includes a layered configuration of pre-rolled sheets forming a closed cigar shell which sheets can include a first sheet of homogenized tobacco paper, a second sheet of natural leaf, and an inner core comprising a cigar or cigarillo. One embodiment includes a layered configuration of pre-rolled sheets including a first sheet of natural leaf, a second sheet of homogenized tobacco paper, and a an inner core comprising a cigar or cigarillo. One embodiment, over an inner core comprising a cigar or cigarillo, includes a plurality of pre-rolled sheets numbering 2, 3, 4, 5, 6, 7, 8, 9, 10, 11, 12, 13, 14, 15, 16, 17, 18, 19, 20, 21, 22, 23, 24, 25, 26, 27, 28, 29, or 30. Various embodiments include possible ranges between any of the combinations of the above listed numbers. For example, between 3 and 20, 5 and 15, etc.

One embodiment a cigar shell made of smokable material, such as homogenized herbal paper, homogenized tobacco paper, smoking paper, rice paper, natural leaf, rolling paper, and/or sheets of other smokable materials. One embodiment includes possible combinations of the different types of sheets of homogenized herbal paper, homogenized tobacco paper, smoking paper, rice paper, natural leaf, rolling paper, and/or sheets of other smokable materials. One embodiment includes sheets comprised of different smokable materials chosen from any combination of the following types of materials: hemp, natural leaf, homogenized tobacco paper, pipe tobacco, different types of flavored tobacco, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, *Calea zacatechichi, Leonurus sibericus* Flowers, Wild Dagga Flowers, Klip Dagga Leaf, Damiana, Hookah, Hemia salicifolia, Kava Kava, *Avena sativa*, scotch broom topps, Valarian, capillarius, herba, Wild clip dagga, *Leonurus sibiricus*, Kanna, Sinicuichi, and/or *Lactuca virosa.*

In one embodiment multiple types of smokable filler material used to form the finished cigar can offer the consumer the option of using different types of filler and/or blending between the types of filler included. In one embodiment different types of filler material can be chosen from any combination of the following types of filler material: hemp, herbal materials, pipe tobacco, different types of flavored tobacco, tea leaves, kanna, blue lotus, *salvia, salvia* eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, *Calea zacatechichi, Leonurus sibericus* Flowers, Wild Dagga Flowers, Klip Dagga Leaf, Damiana, Hookah, Hernia salicifolia, Kava Kava, *Avena sativa*, scotch broom topps, Valarian, capillarius, herba, Wild clip dagga, *Leonurus sibiricus*, Kanna, Sinicuichi, and/or *Lactuca virosa.*

One embodiment includes a cigar tip which can be used with the finished tobacco products.

In various embodiments the cigar shell and/or filler materials can be flavored. The flavoring method preferably includes the use of a liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, pina colada, punch, purple, rum, strawberry/kiwi, vanilla, watermelon, wet cherry, and/or whiskey.

The flavors are preferably added to the form casings and/or pre-rolled sheets with a liquid. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

In one embodiment is provided a method of constructing a cigar, comprising the steps of:

(a) providing:

(i) a cigar shell having a longitudinal length with first and second ends, and an interior shell volume located between the first and second ends, (ii) a form mandrel having an interior mandrel volume and being substantially located inside the interior shell volume, (iii) a stuffing rod, (iv) wherein the cigar shell, form mandrel, and stuffing rod are packaged for sale inside packaging;

(b) opening the packaging and removing the cigar shell and the form mandrel from the packaging;

(c) placing smokable filler in both the interior shell volume and the interior mandrel volume;

(d) after step "c", removing the form mandrel from the interior shell volume while placing a force on the smokable filler thereby simultaneously preventing the smokable filler from sliding longitudinally relative to the cigar shell and causing the smokable filler filler to move longitudinally relative to the form mandrel thereby allowing the form mandrel to be separated from the cigar shell while the smokable filler remains in the shell interior; and (e) after step "d" forming a finished cigar from the cigar shell and the smokable filler.

In one embodiment the cigar shell has a blocking tip which is located at the first end of the cigar shell, and further abuts the form.

In one embodiment the cigar shell has a blocking tip which is located at the first end of the cigar shell, and the blocking tip includes first and second blocking sections having blocking porosities that are different from each other.

In one embodiment the first blocking section includes a plurality of adjacent planar panels forming an according blocking section having a plurality of longitudinal openings located between adjacent planar panels, and the second blocking section includes a circular base having a plurality of holes with the plurality of holes being fluidly connected to the plurality of longitudinal openings.

In one embodiment, while the form mandrel is being moved longitudinally relative to the cigar shell, the force is applied to the smokable filler using the stuffing rod being placed in contact with the smokable filler.

In one embodiment, wherein the form mandrel has a mandrel cylindrical wall and in step "c" the stuffing rod is used to compact the smokable filler inside the shell interior, wherein such compaction causing resultant compacting forces from the smokable filler to be transmitted to the mandrel cylindrical wall, however, the form mandrel prevents substantially all of said resultant compacting forces from being transmitted to the shell wall.

In one embodiment, wherein in step "a" the cigar shell includes a sheet having first and second sections, wherein the second section includes a plurality of folding areas, and a circular portion connected to the sheet, wherein the circular area includes a plurality of openings, and in step "b"

the sheet is removed from the packaging and a plurality of folds are made in the second sheet section creating an accordion type blocking area having a plurality of panels, and following the creation of the accordion type blocking area, the circular area is bent over the accordion type blocking area forming a second blocking area creating two blocking areas having different blocking porosities with the according type blocking area having a larger blocking porosity than the second blocking area, and then the first section of the sheet is wrapped around the accordion type blocking area forming a blocking tip, and the blocking tip is inserted into the shell interior at the first end.

In one embodiment, the cigar shell is sealed along the longitudinal length so that access to the shell interior is limited to only from the first or the second end of the cigar shell.

In one embodiment, the cigar shell includes first and second edges which can be moved apart to provide access to the shell interior along the longitudinal length of the cigar shell.

In one embodiment is provided method of constructing a cigar, comprising the steps of:

(a) providing a cigar making kit having:

(i) a cigar shell having a longitudinal length with first and second ends, and an interior shell volume located between the first and second ends, (ii) a form mandrel having an interior mandrel volume and being substantially located inside the interior shell volume, (iii) a stuffing rod, (iv) wherein the cigar shell, form mandrel, and stuffing rod are packaged for sale inside packaging, and (v) a set of instructions instructing:

(1) placement of smokable filler inside the interior shell volume, and (2) removal of the form mandrel from the interior shell volume vial placement of a force on the smokable filler thereby preventing the smokable filler from leaving inside the interior shell volume, and (3) after removal of the form mandrel preparing a finished cigar using the cigar shell and the smokable filler; and (b) following the instructions when using the cigar making kit to construct a finished cigar.

In one embodiment is provided a method of constructing a cigar, comprising the steps of:

(a) providing:

(i) a cigar shell having a longitudinal length with first and second shell ends, and an interior shell bore extending between the first and second shell ends, (ii) a form mandrel having a longitudinal length with first and second mandrel ends, an interior mandrel volume, wherein the form mandrel is coaxially nested in the cigar shell with the first mandrel end being located in the shell interior and the second mandrel end being located outside of the shell interior, (iii) a stuffing rod, (iv) wherein the cigar shell, form mandrel, and stuffing rod are packaged for sale inside packaging;

(b) opening the packaging and removing the cigar shell and the form mandrel from the packaging;

(c) placing smokable filler in both the interior shell volume and the interior mandrel volume;

(d) after step "c", grabbing the second mandrel end to remove the form mandrel from the interior shell volume while placing a force on the smokable filler thereby simultaneously preventing the smokable filler from sliding longitudinally relative to the cigar shell and causing the smokable filler filler to move longitudinally relative to the form mandrel thereby allowing the form mandrel to be separated from the cigar shell while the smokable filler remains in the shell interior; and (e) after step "d" forming a finished cigar from the cigar shell and the smokable filler.

BRIEF DESCRIPTION OF DRAWINGS

For a further understanding of the nature, objects, and advantages of the present invention, reference should be had to the following detailed description, read in conjunction with the following drawings, wherein like reference numerals denote like elements and wherein:

FIG. 1 is a top view of one embodiment of a sheet that can be made into a blocking tip (for incorporation into a cigar shell) with the blocking tip having two different blocking sections of varying porosities.

FIG. 2 is a top view of the sheet of FIG. 1 schematically indicating the folding of various panels of to form a second blocking section with an "accordion type" blocking section and having open areas between the various folded panel sections.

FIG. 3 is a perspective view of the sheet of FIG. 2 showing the second blocking section being fully formed as an accordion type blocking section along with a portion of the sheet being wrapped around the accordion type blocking section to provide additional structural support, and the first blocking section providing an option to either use or remove it from the sheet.

FIG. 4 is a perspective view of the sheet of FIG. 2 schematically indicating continued wrapping of the portion of the sheet being wrapped around the accordion type blocking section to provide additional structural support.

FIG. 5 is a perspective view of the sheet of FIG. 2 schematically indicating completed wrapping of the portion of the sheet being wrapped around the accordion type blocking section to provide additional structural support.

FIG. 6 is a perspective view of the sheet of FIG. 2 schematically indicating that the first blocking section has been placed on top of the second blocking section thereby providing the dual scheme of different blocking porosities comparing the first blocking section to the second blocking section.

FIG. 28 is a top view of a second embodiment of a sheet that can be made into a blocking tip (for incorporation into a cigar shell).

FIG. 29 is a top view of the sheet of FIG. 28 schematically indicating the folding of various panels of to form a second blocking section with an "accordion type" blocking section and having open areas between the various folded panel sections.

FIG. 30 is a perspective view of the sheet of FIG. 29 showing the second blocking section being fully formed as an accordion type blocking section along with a portion of the sheet being wrapped around the accordion type blocking section to provide additional structural support FIG. 31 is a top view showing a second embodiment of a detached first blocking section providing an option to add it to the second blocking section.

FIG. 32 shows the legs of the first blocking section being folded downwardly to allow it to be placed on the second blocking section.

FIG. 33 is a perspective view of the sheet of FIG. 30 schematically indicating continued wrapping of the portion of the sheet being wrapped around the accordion type blocking section to provide additional structural support along with the addition of the first blocking section.

FIG. 34 is a perspective view of the sheet of FIG. 33 schematically indicating completed wrapping of the portion of the sheet being wrapped around the accordion type blocking section to provide additional structural support, along with the placement of the first blocking section onto the wrapped sheet.

FIG. 35 is a perspective view of the sheet of FIG. 34 schematically indicating that the first blocking section has been placed on top of the second blocking section thereby providing the dual scheme of different blocking porosities comparing the first blocking section to the second blocking section.

DETAILED DESCRIPTION OF THE INVENTION

Figure 7:
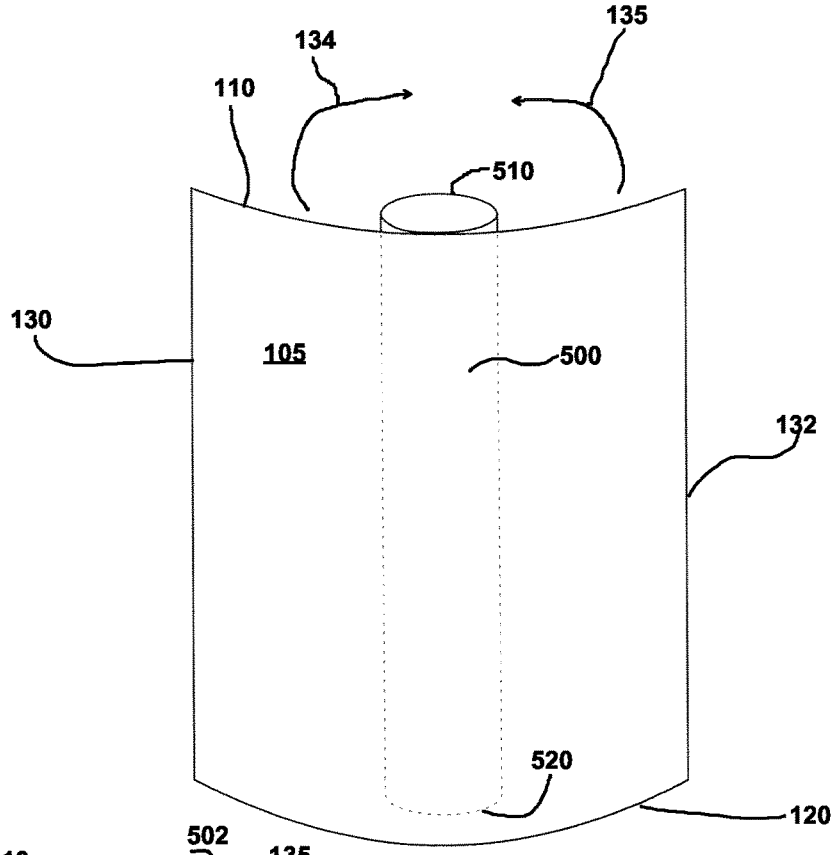
FIG. 7 is a perspective view schematically indicating the formation of a cigar shell from one or more smokable sheets into a cylindrical shell which is supported by form mandrel.

FIG. 1 is a top view of one embodiment of a sheet 205 that can be made into a blocking tip 200 (for incorporation into a cigar shell 100) with the blocking tip 200 having two different blocking sections of varying porosities (e.g., first blocking means 300 and second blocking means 250). Sheet 205 can include first 210 and second 220 ends along with a plurality of folds, etches, or perforations 230 which will assist in creating a plurality of folded panels 222 which are better shown in FIG. 2. First blocking means 300 can be attached to sheet 205 via support joint 330.

FIG. 2 is a top view of the sheet 205 schematically indicating (via arrows 234) the folding of various panels of to form a second blocking section 250 with an "accordion type" blocking portion and having various open areas 255 between the various folded panel sections 222. Arrows 234 schematically indicate the folding about plurality of folds, etches, or perforations 230 to create various folded panel sections 222.

FIG. 3 is a perspective view of the sheet 205 showing the second blocking section 250 being fully formed as an accordion type blocking section along with a portion 208 of the sheet 205 being wrapped around the accordion type blocking section to provide additional structural support, and the first blocking section 300 providing an option to either use or remove it from sheet 205.

FIG. 4 is a perspective view of the sheet 205 schematically indicating (via arrow 207) continued wrapping of the portion 208 of the sheet 205 being wrapped around the accordion type blocking section to provide additional structural support. The accordion type blocking section has a plurality of openings 255 created by the folded panels 222.

FIG. 5 is a perspective view of the sheet 205 schematically indicating now completed wrapping of the portion 208 of the sheet 205 being wrapped around the accordion type blocking section to provide additional structural support.

FIG. 6 is a perspective view of the sheet 205 schematically indicating that the first blocking 300 section has been placed on top of the second blocking section 250 thereby providing a dual scheme of different blocking porosities comparing the first blocking section 300 to the second blocking section 250. The porosity of the first blocking section is controlled by the sizes of the plurality of openings or holes 320 in circular face 310. The porosity of second blocking section 250 is controlled by the sizes of the plurality of openings 255 between the plurality of folded panels 222. Generally, because plurality of openings 320 are smaller in size than plurality of open areas 255, then the porosity of second blocking section 250 is larger (e.g., less resistance to gaseous flow) than the porosity of first blocking section 300.

FIG. 7 is a perspective view schematically indicating the formation of a cigar shell 100 from one or more smokable sheets 105 into a cylindrical shell 100 which is supported by form mandrel 500. One or more smokable sheets 105 can have first 110 and second 120 ends with right 132 and left 134 edges.

Figure 8:
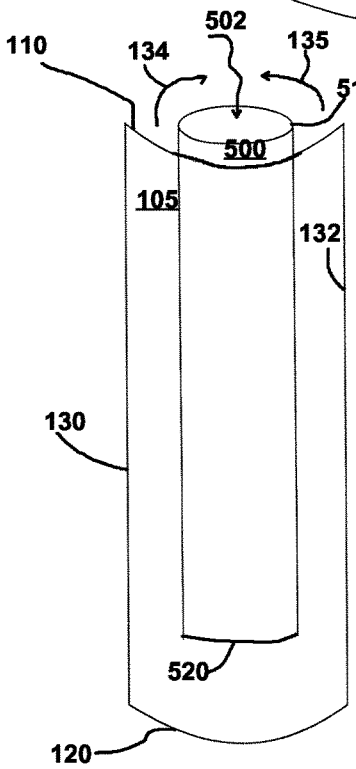
FIG. 8 a perspective view of the one or more sheets of FIG. 7 being wrapped about the form mandrel to form a cigar shell.
Figure 9:
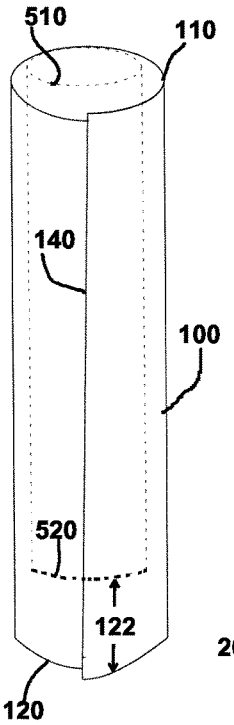
FIG. 9 is a perspective view of showing a cigar shell formed by the one or more sheet of FIG. 7 and further schematically indicating that a blocking tip is being placed in the interior of the cigar shell at one end of the cigar shell.
Figure 10:
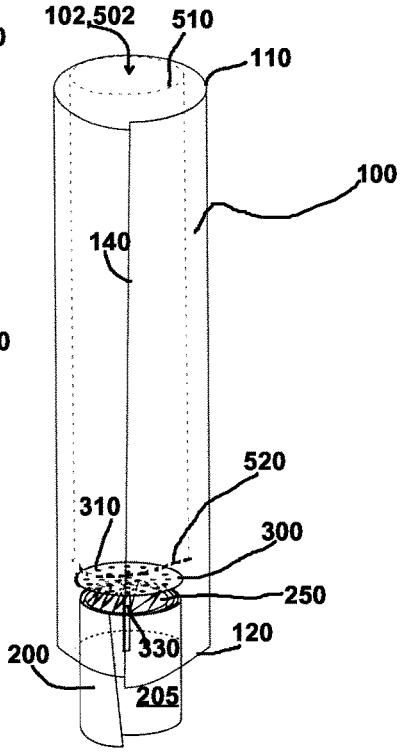
FIGS. 10 through 12 schematically show a cigar shell with a blocking tip and a form mandrel in combination with a stuffing rod or straw all being packaged for sale in packaging (e.g., a foil pouch). The cigar form mandrel in these figures does not have to be the same form mandrel used to form the cigar shell. Additionally, the stuffing straw or rod can be placed in the interior of the cigar shell (and the interior of the supporting form mandrel, or can be placed on the side of the cigar shell.

FIG. 8 a perspective view of the one or more sheets 105 being wrapped about the form mandrel 500 (schematically indicated by arrows 134 and 135) to form a cigar shell 100. FIG. 9 is a perspective view showing cigar shell 100 now formed by one or more sheets 105 and further FIG. 10 schematically indicating that a blocking tip 200 is being placed in the interior 102 of the cigar shell 100 at one end of the cigar shell (here second end 120). After such construction cigar shell 100 has interior or bore 102 which extends between first 110 and second 120 ends with form mandrel 500 being placed inside shell interior 102 such that second end 520 is located inside shell interior 102 and first end 510 is located outside of shell interior 102. In this manner hollow form mandrel 500 can be nested inside and coaxially positioned relative to cigar shell 100, and can provide support to the relatively weak wall of cigar shell 100.

Form mandrel 500 can be generally cylindrical with first 510 and second 520 ends along and mandrel interior 502 spanning between first 510 and second 520 ends. Overlapped area 140 can be unsealed (allowing edges 132 and 134 to be optionally moved apart by a user) or sealed together such as via the use of an adhesive such as cigar glue or other adhesive.

Blocking tip 200 can include first 300 and second 250 blocking portions. Blocking tip 200 can be located inside of shell interior 102 and in FIG. 10 is shown being inserted via second end 120 of cigar shell 100. Blocking tip 200 is preferably located outside of form interior 502 and adjacent to form mandrel 500 while both blocking tip 200 and form mandrel are located inside shell interior 102. In this manner a gap (schematically indicated by dimension 122) can exist between second end 520 of form mandrel 500 and second end 120 of cigar shell 100.

Figure 11:
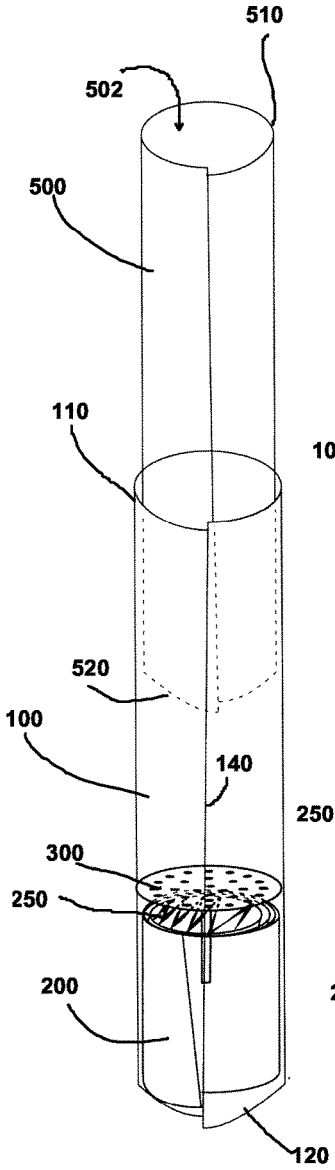
Figure 12:
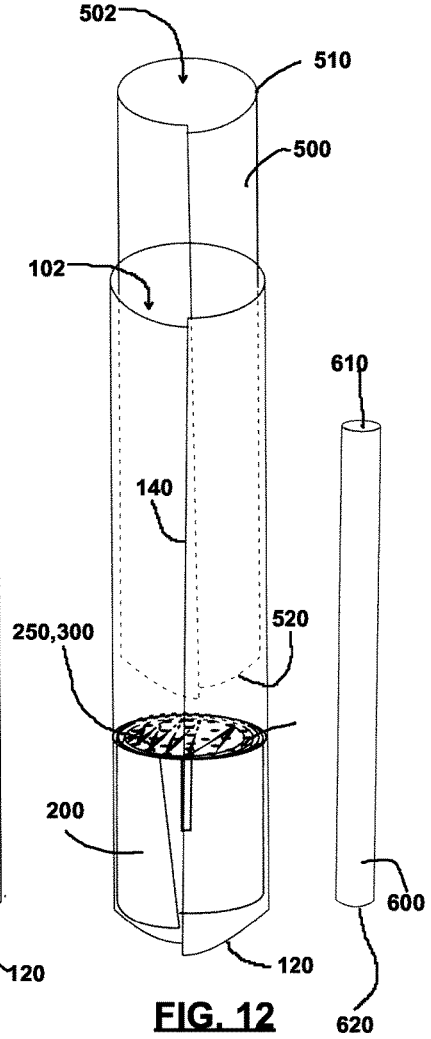
Figure 13:
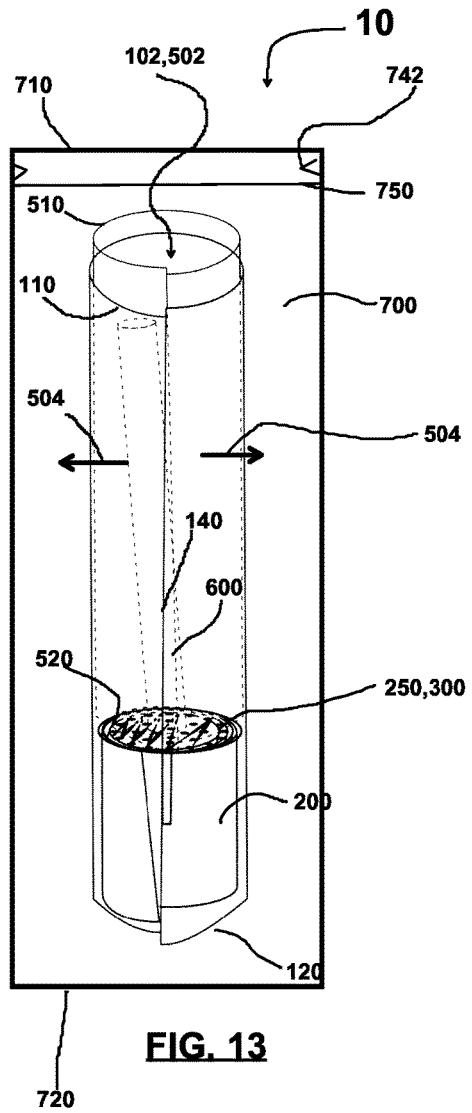
FIG. 13 is a top view of commercial packaging (e.g., foil pouch) containing a cigar shell whose interior contain a form mandrel that supports the shell in its cylindrical shape from being crushed or deformed before being removed from the packaging. A straw or rod is placed inside the interior supported with a form mandrel two cigars or cigarillos each having a form mandrel or straw along its longitudinal centerline.

FIGS. 11 through 13 schematically show a cigar shell 100 with blocking tip 200 and a form mandrel 500 in combination with a stuffing rod or straw 600 all being packaged for sale in packaging 700 (e.g., a foil pouch). The cigar form mandrel 500 in these figures does not have to be the same form mandrel used to form the cigar shell 100 shown in FIGS. 7 through 10. Additionally, the stuffing straw or rod 600 can be placed in the interior 102 of the cigar shell 100 (and the interior 502 of the supporting form mandrel 500, or can be placed on the side of the cigar shell 100 inside the interior of the packaging 700.

FIG. 13 is a top view of commercial packaging 700 (e.g., foil pouch) containing a cigar shell 100 whose interior contains a form mandrel 500 that supports the shell 100 in its cylindrical shape from being crushed or deformed before being removed from the packaging 700. Arrows 504 schematically indicate that form mandrel is resisting a crushing or deforming force placed on packaging 700 to prevent cigar shell 100 for losing its cylindrical shape. A straw or rod 600 can be placed inside the interior 502 of form mandrel 500 and simultaneously inside the shell interior 102.

Package 700 can provide a resealable closure 750 (and/or a tear notch) for enabling access to the packaging 700 interior 740. The resealable closure 750 can be sealed as manufactured to prevent contamination from moisture. Packaging 700 can thus have an interior 740 that is of a controlled environment upon manufacture. By tearing package 700 at tear notch 742, package 700 can be opened.

Figure 14:
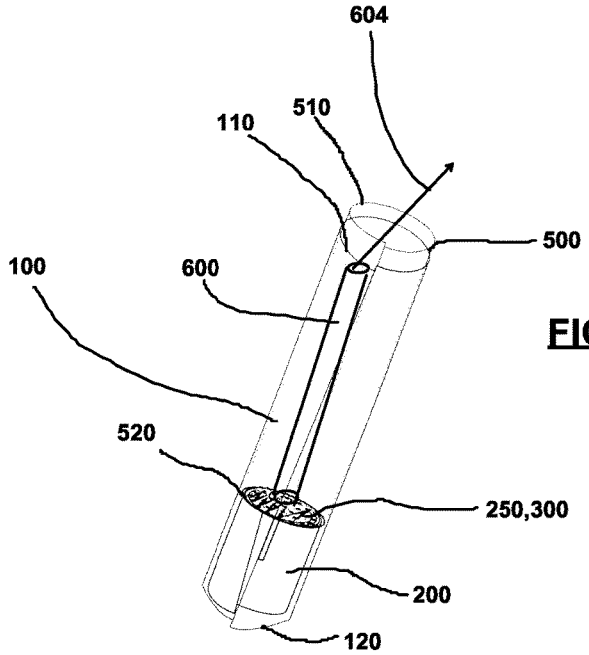
FIG. 14 is a perspective view of the cigar shell of FIGS. 11-13 after being removed from the packaging and is no ready for a user to make a custom cigar with customized smokable filler.

FIG. 14 is a perspective view of the cigar shell 100 of FIGS. 11-13 after being removed from the packaging 700 and is now ready for a user to make a custom cigar 20 with customized smokable filler 400.

Figure 15:
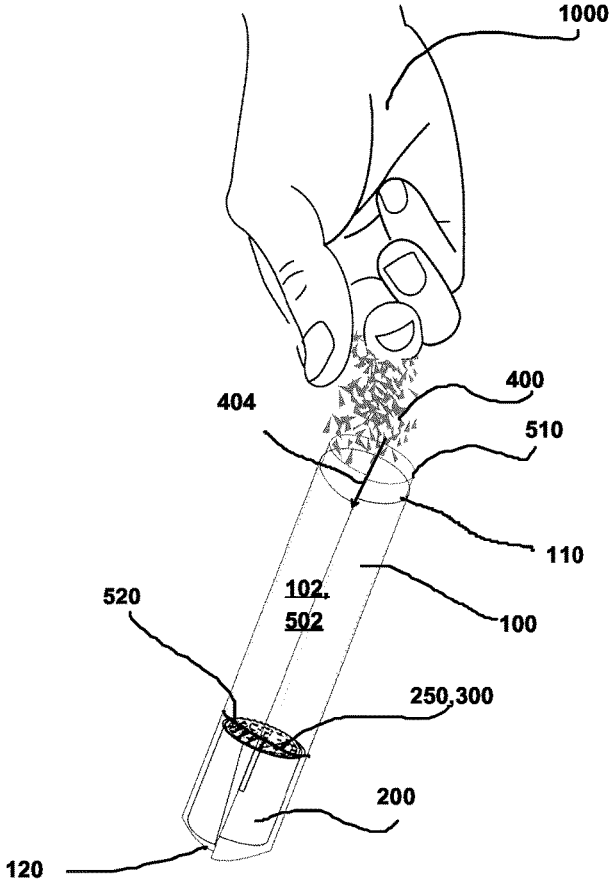
FIG. 15 is a perspective view of the cigar shell of FIG. 11-13 schematically indicating a user adding smokable filler to the interior of the cigar shell (which is also the interior of the form mandrel which is coaxially located in the interior of the cigar shell to provides protection and support to the side wall of the cigar shell during the filling and compacting process with smokable filler).

FIG. 15 is a perspective view of the cigar shell 100 of FIG. 11-13 schematically indicating a user adding a first quantity of smokable filler 400 to the interior 102 of the cigar shell 100 (which is also the interior 502 of the form mandrel 100 which is coaxially located in the interior 102 of the cigar shell 100 to provides protection and support to the side wall 105 of the cigar shell 100 during the filling and compacting process with smokable filler 400).

Figure 16:
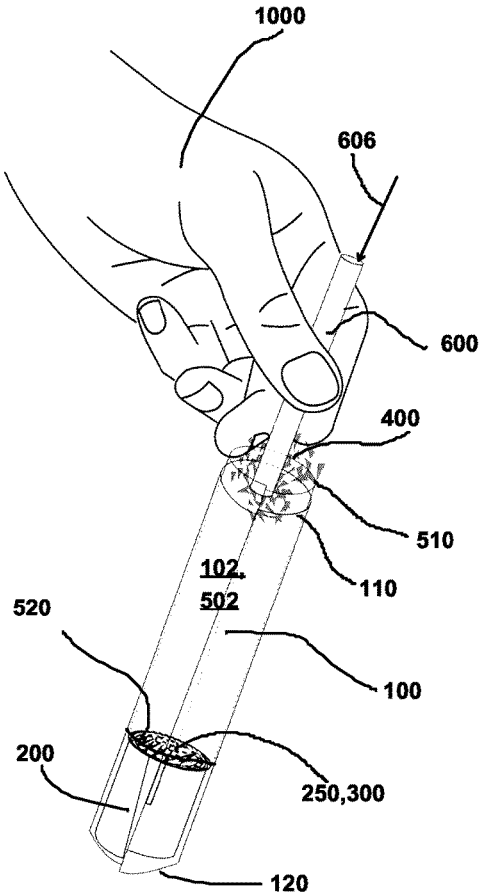
FIGS. 16 and 17 are perspective views schematically indicating a person using the supplied rod to compact and/or compress the smokable filler added in FIG. 15.
Figure 17:
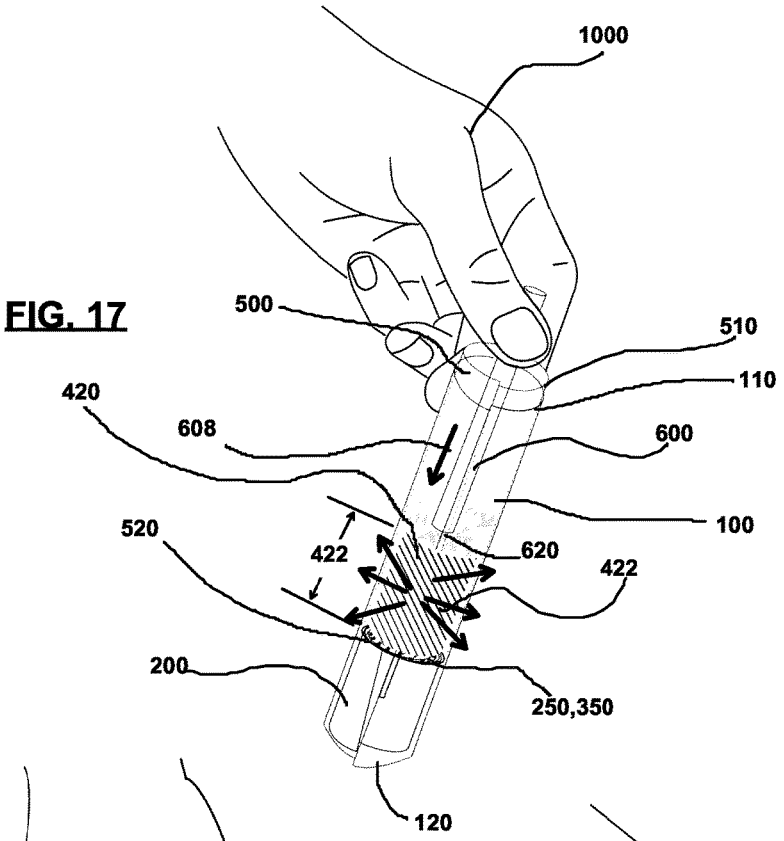

FIGS. 16 and 17 are perspective views schematically indicating a person using the supplied rod 600 to compact and/or compress the first portion of smokable filler 400 added in FIG. 15.

Figure 18:
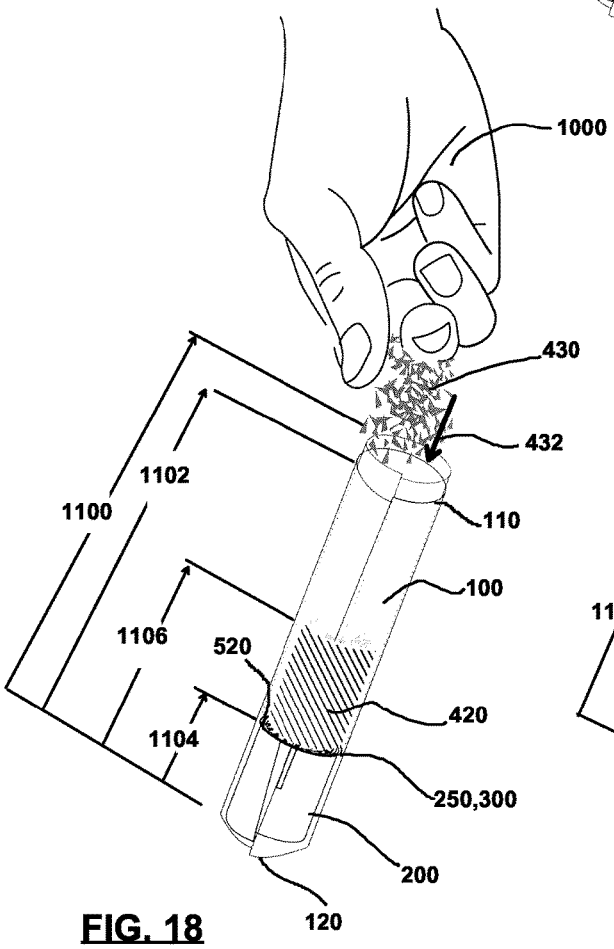
FIGS. 18 and 19 are perspective views schematically indicating the additional steps a adding more smokable filler to the cigar shell and performing additional compacting/compressing of the smokable filler while inside the interior of the cigar shell and the interior of the form mandrel.
Figure 19:
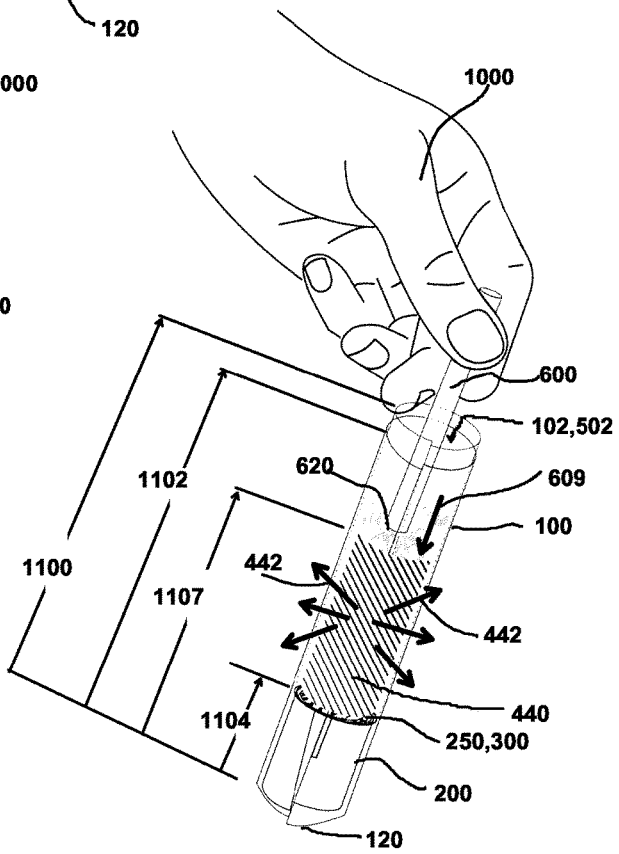
Figures 20, 21, 22, 23:
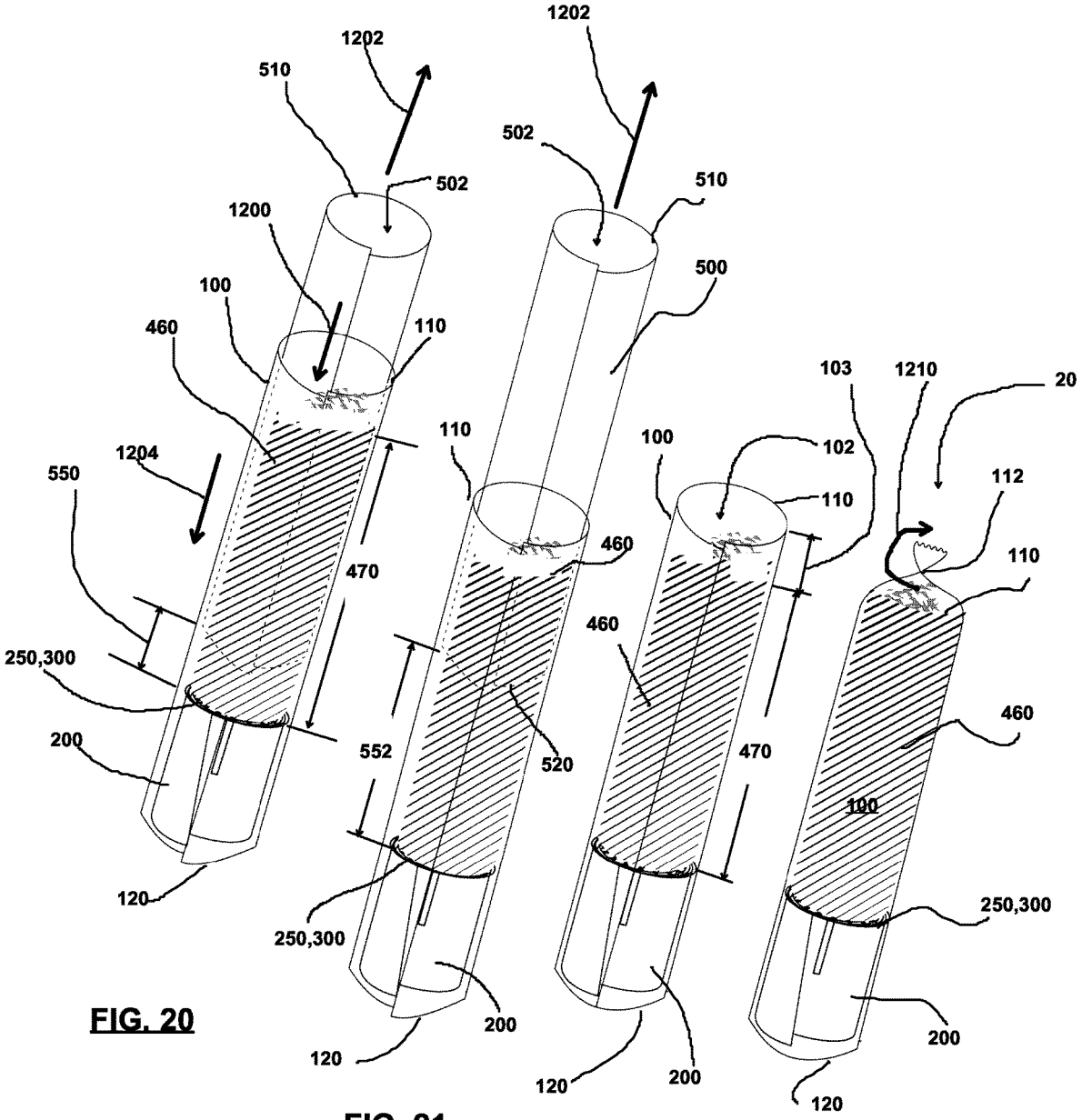
FIGS. 20 through 23 schematically show the final steps, after the consumer finished filling and compacting the added smokable filler, of removing the form mandrel from the interior of the cigar shell (but while preventing the compacted/compressed smokable filler from also being removed during this step) to closing the end of the cigar shell thereby forming a finished cigar with the user's custom blend of smokable filler.

FIGS. 18 and 19 are perspective views schematically indicating the additional steps a adding a second portion of additional smokable filler 400 to the cigar shell 100 and performing additional compacting/compressing of the second portion of additional smokable filler 400 (along with the first portion of smokable filler 400 added previously) while inside the interior 102 of the cigar shell 100 and the interior 502 of the form mandrel 500. During the process of filling and compacting, blocking tip 200 will reduce or prevent loss of smokable filler 400 via the second end 120 of cigar shell 100. In FIG. 19 arrow 609 schematically indicates that rod or straw 600 is being used to compact the previously added smokable filler 400 (and such compacting can be performed several times with straw 600 being moved back and force in the direction of arrow 609). Such compacting will tend to create reactive forces in the smokable filler being compacted and/or compressed which forces are schematically indicated by arrows 442 in FIG. 19. Without form mandrel 500 acting as a protector for cigar shell 100, these reactive forces 442 which temporarily arise during the time that the straw or rod 600 is being used to compact/compress smokable filler inside shell interior 102, would have a substantial chance of causing damage (e.g., tears, holes, or rips) to shell wall 105. However, during compaction and/or compression of the smokable filler, form mandrel 500 prevents the transfer of these transient/temporary localized forces to cigar shell 100 wall 105 and further causes these forces to be spread out into numerous directions in the smokable filler 400 itself and helping to more uniformly compact the smokable filler.

Figure 25:
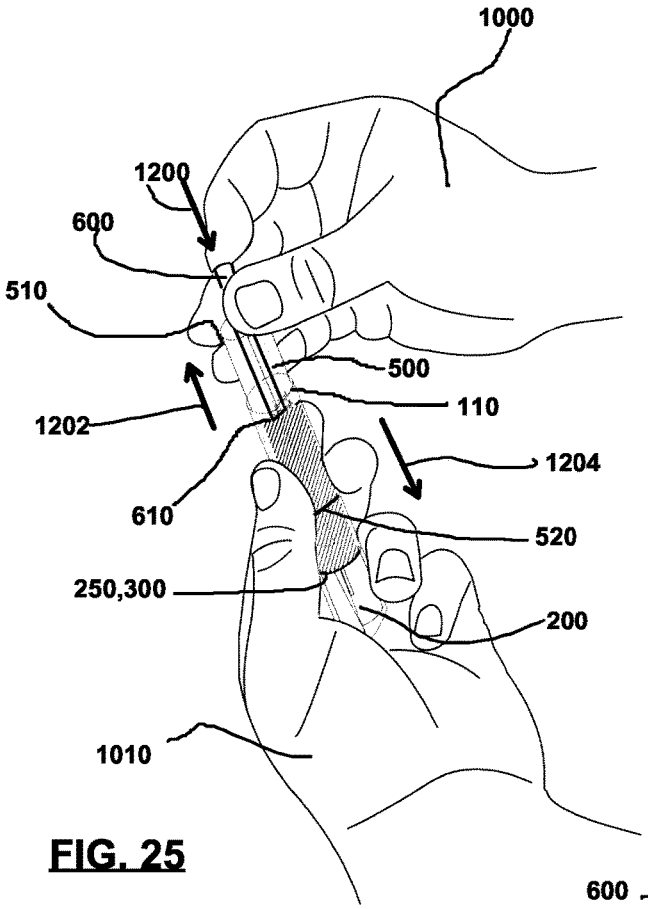
FIGS. 24 through 27 are perspective views showing the final steps, after the consumer finished filling and compacting the added smokable filler, of removing the form mandrel from the interior of the cigar shell (but while preventing the compacted/compressed smokable filler from also being removed during this step) to closing the end of the cigar shell thereby forming a finished cigar with the user's custom blend of smokable filler.
Figure 24:
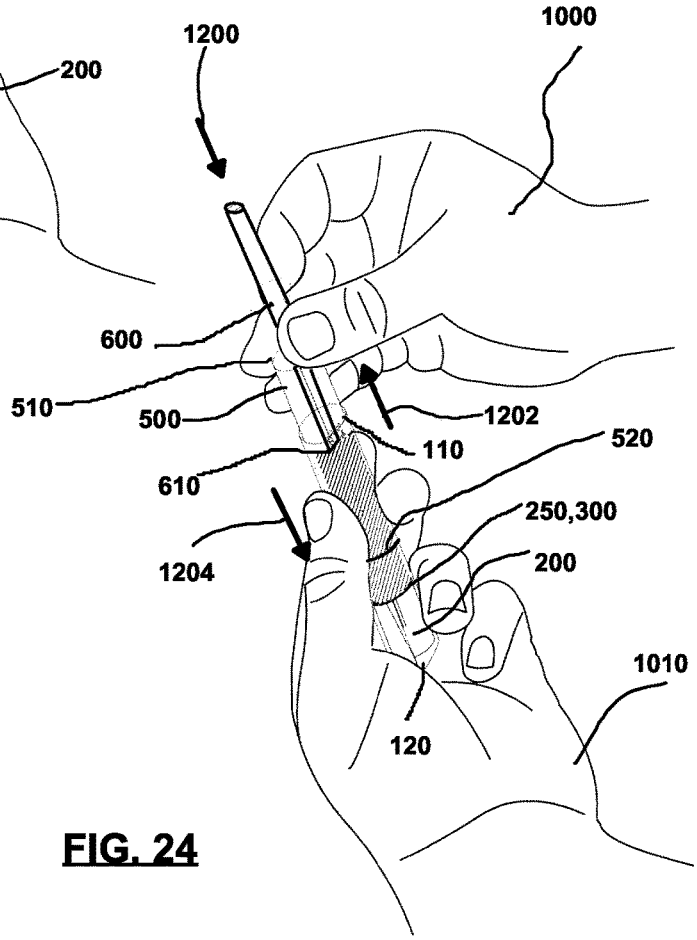
Figure 26:
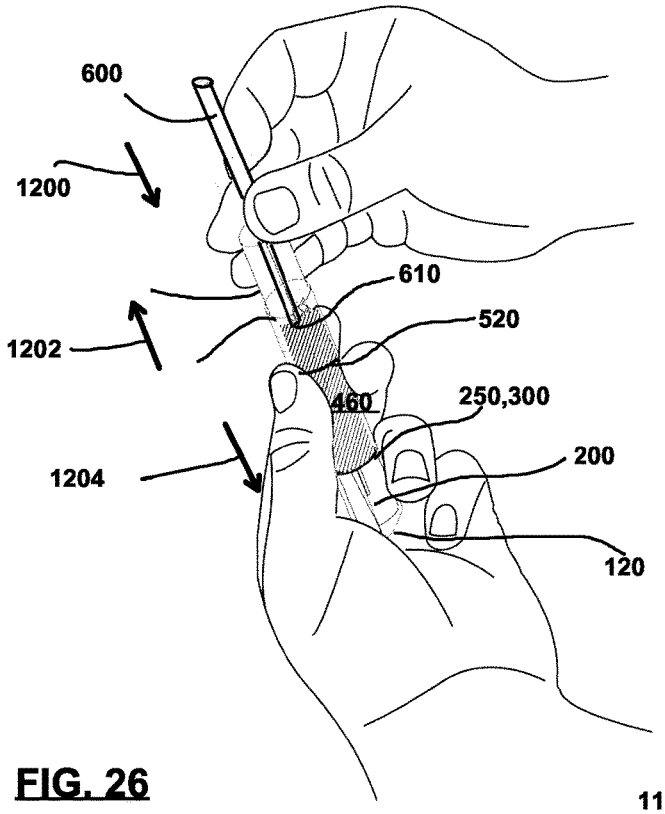

FIGS. 20 through 23 schematically show the final steps, after the consumer finished filling and compacting the added smokable filler 400, of removing the form mandrel 500 from the interior 102 of the cigar shell 100 (and simultaneously preventing the previously added and compacted/compressed smokable filler 400 from being removed from the interior 102 during this step) to closing the first end 110 of the cigar shell 100 thereby forming a finished cigar 20 with the user's 1000 custom blend of smokable filler 400. FIGS. 24 through 26 are perspective views showing the final steps, after the consumer finished filling and compacting the added smokable filler 400, of removing the form mandrel 500 from the interior 102 of the cigar shell 100 (but while preventing the compacted/compressed smokable filler 400 from also being removed during this step) to closing the end of the cigar shell 100 thereby forming a finished cigar 20 with the user's custom blend of smokable filler 20.

A user holds the outside of cigar shell 100 with one hand (hand 1010). Hand 1000 simultaneously holds form mandrel 500 and straw or rod 600. Hand 1010 applies a force to cigar shell 100 in the direction of arrow 1024 and prevents blocking tip from leaving the interior of 102 of cigar shell. At the same time hand 1000 simultaneously applied a force on form mandrel 500 in the direction of arrow 1202 and a force on rod or stick 600 in the direction of arrow 1200. In this manner, form mandrel 500 is slid out of (in the direction of arrow 1202) cigar shell 100 while smokable filler is prevented from also sliding out of cigar shell 100, but instead caused to slid out of the interior 502 of form mandrel 500. In this way form mandrel 500 can be removed from cigar shell 100 while smokable filler 400 remains in cigar shell 100.

Figure 27:
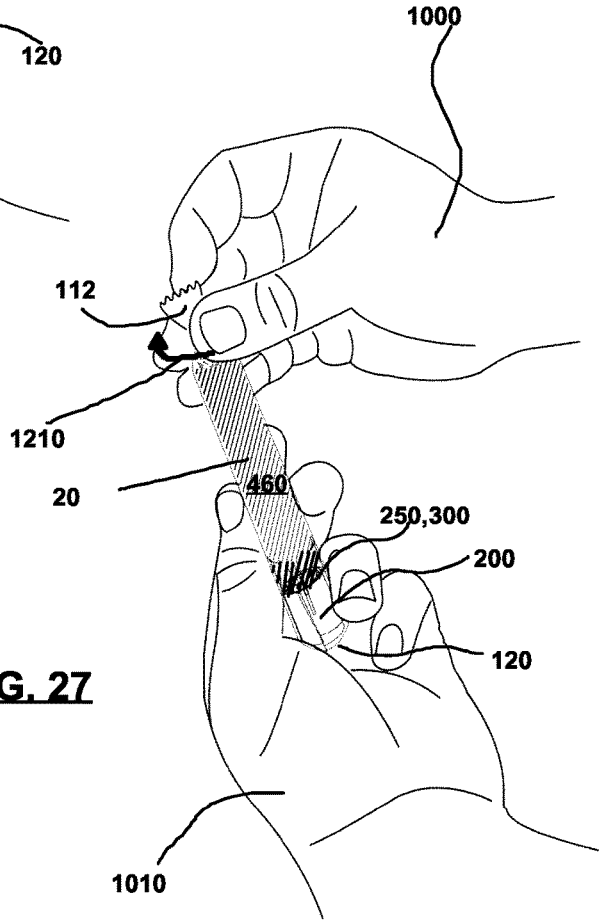

FIG. 27 schematically shows a step of closing the end 110 of the cigar shell 100 (twisting of first end 110 schematically indicated by arrow 112) thereby forming a finished cigar 20 with the user's custom blend of smokable filler 400. In various embodiments a user does not need to close the end 110 but can smoke the finished cgar 20 with an open end.

Second end 120 (with blocking tip) can be placed in consumer's mouth while first end 110 can be lit. As consumer sucks in air is pulled into end 110 passing the smokable filler and contacting the blocking tip 200 where two different porosities are experienced by the flow air: second blocking means 300 where a plurality of openings or perforations 320 are found, and then once passing second blocking means 300 then to first blocking means 250 where a plurality of open areas 255 are seen. It is likely that the smaller porosity of second blocking means 300 (relative to the larger porosity of the first blocking means 250) will control the overall resistance that first 300 and second blocking means 250 give to air flow and/or drag. Additionally, first blocking means smaller porosity is expected to prevent/block smokable filler (except very fine particles) from coming out of shell interior 102, and second blocking means 250 can server as a structural support or tip for holding finished cigar 20.

In one embodiment the first blocking porosity (e.g., plurality of openings or perforations 320) of first blocking section 300 has a mean pore size which is smaller than the mean pore size of the second blocking porosity (e.g., the plurality of open areas 255 of second blocking section 250). In various embodiments the different blocking sections of varying porosities can be modified to regulator the airflow of the smokable product (e.g., air flow through finished cigar 20). In various embodiments the first blocking porosity has a mean pore size which is less than ½ the mean pore size of the second blocking porosity. In various embodiments the mean pore size of the first blocking porosity is less than ½, ⅓, ¼, ⅕, ⅙, 1/10, 1/11, 1/12, 1/15, 1/20, 1/25, 1/30, 1/35, 1/40, 1/50, 1/60, 1/75, 1/80, 1/90, 1/100, 1/125, 1/150/1/175, and/or 1/200 the means pore size of the second blocking porosity. In various embodiments the mean pore size of the first blocking porosity can fall within a range of between any two of the above referenced relative sizes of the second blocking porosity.

FIGS. 28 through 35 illustrate a second embodiment where the second blocking means 250 is separate from the first blocking means 300.

FIG. 28 is a top view of one embodiment of a sheet 205 that can be made into a blocking tip 200 (for incorporation into a cigar shell 100) with the blocking tip 200 having two different blocking sections of varying porosities (e.g., first blocking means 300 and second blocking means 250). Sheet 205 can include first 210 and second 220 ends along with a plurality of folds, etches, or perforations 230 which will assist in creating a plurality of folded panels 222 which are better shown in FIG. 2. FIG. 29 is a top view of the sheet 205 schematically indicating (via arrows 234) the folding of various panels of to form a second blocking section 250 with an "accordion type" blocking portion and having various open areas 255 between the various folded panel sections 222. Arrows 234 schematically indicate the folding about plurality of folds, etches, or perforations 230 to create various folded panel sections 222. FIG. 30 is a perspective view of the sheet 205 showing the second blocking section 250 being fully formed as an accordion type blocking section along with a portion 208 of the sheet 205 being wrapped around the accordion type blocking section FIG. 30 is a perspective view of the sheet 205 schematically indicating (via arrow 207) continued wrapping of the portion 208 of the sheet 205 being wrapped around the accordion type blocking section to provide additional structural support. The accordion type blocking section has a plurality of openings 255 created by the folded panels 222.

FIG. 31 shows first blocking means 300 including arms 300 and 330, where first blocking means is separated from sheet 205. FIG. 32 is a perspective view of first blocking means 300 where arms 330 and 335 have been folded.

FIG. 34 is a perspective view of the sheet 205 schematically indicating now completed wrapping of the portion 208 of the sheet 205 being wrapped around the accordion type blocking section to provide additional structural support.

FIGS. 34 and 35 are perspective views of the sheet 205 schematically indicating that the first blocking section 300 is being placed on top of the second blocking section 250 thereby providing a dual scheme of different blocking porosities comparing the first blocking section 300 to the second blocking section 250. The placement of first blocking section 300 on top of second blocking section 250 can be done either before or after second blocking section 2502 is placed in cigar shell 100. For example, FIG. 10 schematically shows both first 300 and second 250 blocking sections being placed together in cigar shell 100. Alternatively second blocking section 250 can be initially placed in cigar shell 100, and thereafter first blocking section 300 can be placed in cigar shell 100 on top of second blocking section 250. The porosity of the first blocking section is controlled by the sizes of the plurality of openings or holes 320 in circular face 310. The porosity of second blocking section 250 is controlled by the sizes of the plurality of openings 255 between the plurality of folded panels 222. Generally, because plurality of openings 320 are smaller in size than plurality of open areas 255, then the porosity of second blocking section 250 is larger (e.g., less resistance to gaseous flow) than the porosity of first blocking section 300.

In different embodiments combinations of sheets made of different smoking materials, such as homogenized tobacco paper, natural leaf, rolling paper, and/or sheets of other smokable materials can be used in manufacturing cigars or cigarillos of controlled burned rates. One embodiment includes possible combinations of the different types of sheets of homogenized tobacco paper, natural leaf, rolling paper, and/or sheets of other smokable materials. One embodiment includes sheets comprised of different smokable materials chosen from any combination of the following types of materials: natural leaf, homogenized tobacco paper, pipe tobacco, different types of flavored tobacco, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, *Calea zacatechichi, Leonurus sibericus* Flowers, Wild Dagga Flowers, Klip Dagga Leaf, Damiana, Hookah, Hernia salicifolia, Kava Kava, *Avena sativa*, scotch broom topps, Valarian, capillarius, herba, Wild clip dagga, *Leonurus sibiricus*, Kanna, Sinicuichi, and/or *Lactuca virosa*.

The following is a list of reference numerals which are used in this application.

LIST OF REFERENCE NUMERALS

| Reference Number | Description |
|---|---|
| 10 | smoking kit |
| 20 | finished cigar |
| 100 | cigar shell |
| 102 | interior of cigar shell |
| 103 | non-filled portion of shell interior |
| 105 | one or more sheets forming cylindrical wall |
| 110 | first end |
| 112 | twist top |
| 120 | second end |
| 122 | spacing |
| 130 | first edge |
| 132 | second edge |
| 134 | arrow |
| 135 | arrow |
| 140 | overlaped or sealed area |
| 150 | shell interior, bore, space or cavity |
| 200 | blocking tip |
| 205 | sheet |
| 208 | first portion |
| 207 | arrow |
| 210 | first end |
| 212 | intermediate point |
| 220 | second end |
| 222 | plurality of panels |
| 230 | plurality of folds, etched, or perforations forming a plurality of panels |
| 232 | arrow |
| 234 | arrows |
| 240 | zig zag or area of folds |
| 250 | first blocking means |
| 255 | plurality of open areas |
| 300 | second blocking means |
| 310 | circular face |
| 320 | plurality of openings or perforations |
| 330 | first support or joint |
| 332 | arrow |
| 335 | second support or joint |
| 400 | smokable filler |
| 404 | arrow |
| 420 | smokable filler being stuffed/compacted |
| 422 | volume of compacted smokable filler |
| 430 | additional smokable filler being stuffed/compacted |
| 432 | arrow |
| 440 | additional smokable filler being stuffed/compacted |
| 442 | arrows schematically indicating localized forces from compacting/consolidating smokable filler inside interiors of cigar shell and form mandrel |
| 460 | finished amount of compacted/consolidated smokable filler |
| 470 | length of finished amount of compacted/consolidated smokable filler |
| 500 | form casing |
| 502 | interior of form casing |
| 504 | arrows |
| 510 | first end |
| 520 | second end |
| 540 | sealed area |
| 552 | distance of second end of form casing to blocking tip |
| 600 | rod or straw |
| 604 | arrow |
| 606 | arrow |
| 608 | arrow |
| 609 | arrow |
| 610 | end |
| 700 | packaging |
| 702 | tear notch |
| 710 | first end |
| 720 | second end |
| 740 | interior |
| 750 | closing means (e.g., zip lock) |
| 1000 | user |
| 1010 | second hand of user |
| 1100 | length |

-continued

LIST OF REFERENCE NUMERALS

| Reference Number | Description |
|---|---|
| 1102 | length |
| 1104 | length |
| 1106 | length |
| 1108 | length |
| 1200 | arrow |
| 1202 | arrow |
| 1204 | arrow |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of constructing a cigar, comprising the steps of:

(a) providing:

(i) a cigar shell having a longitudinal length with first and second ends, and an interior shell volume located between the first and second ends, (ii) a form mandrel having an interior mandrel volume and being substantially located inside the interior shell volume, (iii) a stuffing rod, (iv) wherein the cigar shell, form mandrel, and stuffing rod are packaged for sale inside packaging; and the cigar shell has a blocking tip which is located at the first end of the cigar shell, and the blocking tip includes first and second blocking sections having blocking porosities that are different from each other;

(b) opening the packaging and removing the cigar shell and the form mandrel from the packaging;

(c) placing smokable filler in both the interior shell volume and the interior mandrel volume;

(d) after step "c", removing the form mandrel from the interior shell volume while placing a force on the smokable filler thereby simultaneously preventing the smokable filler from sliding longitudinally relative to the cigar shell and causing the smokable filler filler to move longitudinally relative to the form mandrel thereby allowing the form mandrel to be separated from the cigar shell while the smokable filler remains in the shell interior; and (e) after step "d" forming a finished cigar from the cigar shell and the smokable filler.

2. The method of claim 1, wherein in step "a" the blocking tip abuts the form mandrel.

3. The method of claim 1, wherein the first blocking section includes a plurality of adjacent planar panels forming an accordian blocking section having a plurality of longitudinal openings located between adjacent planar panels, and the second blocking section includes a circular base having a plurality of holes with the plurality of holes being fluidly connected to the plurality of longitudinal openings.

4. The method of claim 1, wherein in step "d", while the form mandrel is being moved longitudinally relative to the cigar shell, the force is applied to the smokable filler using the stuffing rod being placed in contact with the smokable filler.

5. A method of constructing a cigar, comprising the steps of:

(a) providing:

(i) a cigar shell having a longitudinal length with first and second ends, and an interior shell volume located between the first and second ends, (ii) a form mandrel having an interior mandrel volume and being substantially located inside the interior shell volume, (iii) a stuffing rod, (iv) wherein the cigar shell, form mandrel, and stuffing rod are packaged for sale inside packaging;

(b) opening the packaging and removing the cigar shell and the form mandrel from the packaging;

(c) placing smokable filler in both the interior shell volume and the interior mandrel volume;

(d) after step "c", removing the form mandrel from the interior shell volume while placing a force on the smokable filler thereby simultaneously preventing the smokable filler from sliding longitudinally relative to the cigar shell and causing the smokable filler filler to move longitudinally relative to the form mandrel thereby allowing the form mandrel to be separated from the cigar shell while the smokable filler remains in the shell interior;

(e) after step "d" forming a finished cigar from the cigar shell and the smokable filler; and wherein the form mandrel has a mandrel cylindrical wall and in step "c" the stuffing rod is used to compact the smokable filler inside the shell interior, wherein such compaction causing resultant compacting forces from the smokable filler to be transmitted to the mandrel cylindrical wall, however, the form mandrel prevents substantially all of said resultant compacting forces from being transmitted to the shell wall.

6. A method of constructing a cigar, comprising the steps of:

(a) providing:

(i) a cigar shell having a longitudinal length with first and second ends, and an interior shell volume located between the first and second ends, (ii) a form mandrel having an interior mandrel volume and being substantially located inside the interior shell volume, (iii) a stuffing rod, (iv) wherein the cigar shell, form mandrel, and stuffing rod are packaged for sale inside packaging;

(b) opening the packaging and removing the cigar shell and the form mandrel from the packaging;

(c) placing smokable filler in both the interior shell volume and the interior mandrel volume;

(d) after step "c", removing the form mandrel from the interior shell volume while placing a force on the smokable filler thereby simultaneously preventing the smokable filler from sliding longitudinally relative to the cigar shell and causing the smokable filler filler to move longitudinally relative to the form mandrel thereby allowing the form mandrel to be separated from the cigar shell while the smokable filler remains in the shell interior;

(e) after step "d" forming a finished cigar from the cigar shell and the smokable filler; and wherein in step "a" the cigar shell includes a sheet having first and second sections, wherein the second section includes a plurality of folding areas, and a circular portion connected to the sheet, wherein the circular portion includes a plurality of openings, and in step "b" the sheet is removed from the packaging and a plurality of folds are made in the second sheet section creating an accordion type blocking area having a plurality of panels, and following the creation of the accordion type blocking area, the circular portion is bent over the accordion type blocking area forming a circular portion blocking area creating two blocking areas having different blocking porosities with the accordion type blocking area having a larger blocking porosity than the circular portion blocking area, and then the first section of the sheet is wrapped around the accordion type blocking area forming a blocking tip, and the blocking tip is inserted into the shell interior at the first end.

7. The method of claim 6, wherein in step "d", while the form mandrel is being moved longitudinally relative to the cigar shell, the force is applied to the smokable filler using the stuffing rod being placed in contact with the smokable filler.

8. The method of claim 6, wherein the plurality of panels of the accordion type blocking area includes a plurality of adjacent planar panels having a plurality of longitudinal openings located between the adjacent planar panels, and the circular portion blocking area includes a circular base having a plurality of holes with the plurality of holes being fluidly connected to the plurality of longitudinal openings.

9. The method of claim 6, wherein in step "d", while the form mandrel is being moved longitudinally relative to the cigar shell, the force is applied to the smokable filler using the stuffing rod being placed in contact with the smokable filler.

10. The method of claim 1, wherein in step "a" the cigar shell is sealed along the longitudinal length so that access to the shell interior is limited to only from the first or the second end of the cigar shell.

11. A method of constructing a cigar, comprising the steps of:

(a) providing:

(i) a cigar shell having a longitudinal length with first and second ends, and an interior shell volume located between the first and second ends, (ii) a form mandrel having an interior mandrel volume and being substantially located inside the interior shell volume, (iii) a stuffing rod, (iv) wherein the cigar shell, form mandrel, and stuffing rod are packaged for sale inside packaging;

(b) opening the packaging and removing the cigar shell and the form mandrel from the packaging;

(c) placing smokable filler in both the interior shell volume and the interior mandrel volume;

(d) after step "c", removing the form mandrel from the interior shell volume while placing a force on the smokable filler thereby simultaneously preventing the smokable filler from sliding longitudinally relative to the cigar shell and causing the smokable filler filler to move longitudinally relative to the form mandrel thereby allowing the form mandrel to be separated from the cigar shell while the smokable filler remains in the shell interior;

(e) after step "d" forming a finished cigar from the cigar shell and the smokable filler; and wherein in step "a" the cigar shell includes first and second edges which can be moved apart to provide access to the shell interior along the longitudinal length of the cigar shell.

12. The method of claim 11, wherein in step "d", while the form mandrel is being moved longitudinally relative to the cigar shell, the force is applied to the smokable filler using the stuffing rod being placed in contact with the smokable filler.

13. The method of claim 11, wherein in step "a" the cigar shell includes a sheet having first and second sections, wherein the second section includes a plurality of folding areas, and a circular portion connected to the sheet, wherein the circular area includes a plurality of openings, and in step "b" the sheet is removed from the packaging and a plurality of folds are made in the second sheet section creating an accordion type blocking area having a plurality of panels, and following the creation of the accordion type blocking area, the circular area is bent over the accordion type blocking area forming a circular portion blocking area creating two blocking areas having different blocking porosities with the accordion type blocking area having a larger blocking porosity than the circular portion blocking area, and then the first section of the sheet is wrapped around the accordion type blocking area forming a blocking tip, and the blocking tip is inserted into the shell interior at the first end.

* * * * *